US007487573B2

(12) United States Patent
Celli

(10) Patent No.: US 7,487,573 B2
(45) Date of Patent: Feb. 10, 2009

(54) DEVICE FOR DRY FORMING A WEB OF FIBERS

(75) Inventor: Alessandro Celli, Lucca (IT)

(73) Assignee: A Celli Nonwovens S.p.A., Porcari, Lucca (IT)

( * ) Notice: Subject to any disclaimer, the term of this patent is extended or adjusted under 35 U.S.C. 154(b) by 755 days.

(21) Appl. No.: 10/529,819

(22) PCT Filed: Oct. 15, 2002

(86) PCT No.: PCT/IT02/00657

§ 371 (c)(1),
(2), (4) Date: Mar. 31, 2005

(87) PCT Pub. No.: WO2004/035919

PCT Pub. Date: Apr. 29, 2004

(65) Prior Publication Data

US 2006/0085951 A1 Apr. 27, 2006

(51) Int. Cl.
*D01G 25/00* (2006.01)

(52) U.S. Cl. ..... 19/304

(58) Field of Classification Search ..... 19/304–308; 425/83.1

See application file for complete search history.

(56) References Cited

U.S. PATENT DOCUMENTS 3,575,749 A * 4/1971 Kroyer ..... 156/62.2
3,581,706 A 6/1971 Rasmussen
4,014,635 A 3/1977 Kroyer
4,157,724 A 6/1979 Persson
4,169,699 A 10/1979 Werner
4,212,607 A * 7/1980 Miller ..... 425/83.1
4,268,235 A * 5/1981 Bean et al. ..... 425/83.1
4,276,248 A 6/1981 Widnall
4,285,647 A 8/1981 Dunkerly, II
4,335,066 A 6/1982 Dinius
4,351,793 A 9/1982 Day
4,352,649 A 10/1982 Jacobsen et al.
4,482,308 A 11/1984 Johnson
4,494,278 A 1/1985 Kroyer et al.

(Continued)

FOREIGN PATENT DOCUMENTS

EP 0 032 772 7/1981

(Continued)

*Primary Examiner*—Shaun R Hurley
(74) *Attorney, Agent, or Firm*—McGlew and Tuttle P.C.

(57) ABSTRACT

A device for dry forming a web of fibers. The device includes; a fiber distribution head (1); a forming wire (3) movable under the head; a suction means (5) located on the opposite side of the forming wire from the head; within the head, a chamber (9) into which a flow of gas, in which said fibers are suspended, is directed, the chamber having a bottom opening (9A) closed by a screen mesh (17) which is essentially parallel to the forming wire (3) and which faces the the forming wire; and agitator members (45) inside the chamber, above the screen mesh (17), for agitating and distributing the fibers. The screen mesh (17) is a continuous mesh, movable along a closed path around the chamber, the portion of the mesh parallel to and facing the forming wire moving along a path which is essentially parallel to the forming wire. Additionally, the agitator members comprise a plurality of rotating shafts (47) which are parallel to each other and orthogonal to the direction of advance (f3) of the forming wire.

38 Claims, 9 Drawing Sheets

U.S. PATENT DOCUMENTS

| | | | |
|---|---|---|---|
| 4,627,953 | A | 12/1986 | Johnson |
| 5,471,712 | A | 12/1995 | Kroyer |
| 5,527,171 | A | 6/1996 | Soerensen |
| 6,233,787 | B1 | 5/2001 | Eriksen et al. |

FOREIGN PATENT DOCUMENTS

| | | |
|---|---|---|
| EP | 0 159 618 | 10/1985 |
| EP | 0 188 454 | 7/1986 |
| EP | 0 616 056 | 9/1994 |
| GB | 1 499 687 | 2/1978 |
| GB | 1 559 274 | 1/1980 |
| WO | WO 87/01403 | 3/1987 |
| WO | WO 91/05100 | 4/1991 |
| WO | WO 95/22656 | 8/1995 |
| WO | WO 96/10663 | 4/1996 |
| WO | WO 99/54537 | 10/1999 |

* cited by examiner 1
3
7
9
9P
11
14
17
18A
18B
19
21
25
27
29
31
33
35
37
43
46
53
55
57
63
67
f3
f17

V
IV
1
17
19
f17
57
7
91
7A
73
79
3
35
55
89
21
9c
33
53
81
29
11
9
41
27
37
18A
5
31
23
61
25
87
63
75
67
65
f3
IX

DEVICE FOR DRY FORMING A WEB OF FIBERS

TECHNICAL FIELD

The present invention relates to a device for producing a web or sheet of fibrous material by a dry method, in other words without using a water-based fiber stock.

PRIOR ART

Webs or sheets of fibrous material, particularly paper, absorbent paper, or what is known as "tissue paper", are normally produced by means of processes and machines in which a water-based stock of cellulose fibers is distributed on a forming screen to form a thin web. This web is then dried by suction to remove the water and by subsequent passage over a heated roller or other drying device.

In relatively recent times, a new process was introduced for producing paper, particularly very thick absorbent paper, for example for the production of sanitary articles such as diapers for infants or sanitary pads. In this process, a web of fibers supplied by a flow of air is distributed on a forming screen or wire. This is known as the "airlaid" process.

Devices of various types have been designed for carrying out the dry forming process, in order to make the distribution of fibers as uniform as possible, and in order to overcome many of the drawbacks and problems of this new method.

In general, airlaid webs are produced by suspending the fibers in a flow of air and depositing them on a forming mesh or screen, under which suction is applied to guide the fibers which are supplied from a forming head placed above. The fibers are distributed in the flow of air by various methods.

A first category of devices uses a forming head with a mesh screen located under it, through which the fibers are drawn by a flow of air. A forming wire runs under the mesh screen which closes the underside of the forming head, and the fibers are deposited on the forming wire to form the web. Above the screen closing the underside of the forming head there are propellers rotating about vertical axes, in other words axes orthogonal to the forming wire and to the screen. The fibers are drawn by a flow of air through the screen closing the head and are deposited on the forming wire. Examples of devices made in this way are described in GB-1499687; GB-1559274; U.S. Pat. No. 3,581,706; U.S. Pat. No. 4,014,635; U.S. Pat. No. 4,157,724; U.S. Pat. No. 4,276,248; U.S. Pat. No. 4,285,647; U.S. Pat. No. 4,335,066; U.S. Pat. No. 4,351,793; U.S. Pat. No. 4,482,308; U.S. Pat. No. 4,494,278; U.S. Pat. No. 4,627,953; U.S. Pat. No. 5,527,171; U.S. Pat. No. 5,471,712; WO-A-9105100; WO-A-9522656; WO-A-9610663; WO-A-9954537; EP-B-616056.

A second type of device for distributing the fibers in the flow of air which is sucked through the forming wire makes use of one or more perforated pipes with axes parallel to the forming wire. The fibers drawn by the air emerge from the holes in the pipes and are deposited on the underlying forming wire, which advances in the direction of feeding. EP-A-032772 describes a forming head of this type. A pair of tubes with parallel axes is positioned above the forming wire. The tubes have perforated walls through which the fibers pass out, the fibers being carried by a flow of air inside said tubes. To promote the outflow of the fibers and to prevent their accumulation inside the tubes, rotating shafts, having their axes parallel to the tubes and having radial points, are fitted in the tubes. The points have the additional function of disintegrating any lumps of fibers which form in the flow of air carrying them. Devices based essentially on the same principle are described in U.S. Pat. No. 4,352,649, WO-A-8701403 and EP-B-188454. In these devices, the forming head has no screen closing its underside, and the flow of air and suspended fibers is confined to the interior of the pipes with perforated walls, where the perforated wall has the same function as the screen closing the heads of the first type mentioned above.

U.S. Pat. No. 6,233,787 describes a device for dry forming a web of fibers in which a head which receives a flow of air with the suspended fibers is positioned above the forming wire. The head has in its lower part a set of rotating shafts or rollers, with axes parallel to each other and to the forming wire, and extending transversely with respect to the direction of advance of the forming wire. The shafts or rollers have radial points or rods which extend in such a way that they essentially close the lower aperture of the head, forming a kind of permeable wall which permits the passage of the fibers which are drawn by the flow of air sucked from below the forming head.

EP-A-159618 describes a device for dry forming a web of fibers, comprising a forming head located above the forming screen through which is sucked the flow of air which draws the fibers. The bottom of the forming head is closed by a fixed screen, which is perforated to allow the passage of the fibers. Above the fixed screen there is a plurality of rollers having axes parallel to the forming screen and orthogonal to the direction of advance of the latter. The rollers are equipped with radial points and are supported by a continuous conveyor which moves them in a direction parallel to the direction of advance of the forming screen.

OBJECTS AND SUMMARY OF THE INVENTION

The object of the present invention is to provide a new type of device for producing sheets or webs of fiber material by a dry forming process which is particularly efficient and enables high-quality material to be produced.

This and other objects and advantages, which the following text will make clear to those skilled in the art, are essentially achieved with a device for dry forming a web of fibers, comprising: a fiber distribution head; a forming wire movable under said head; a suction means located on the opposite side of said forming wire from said head; within said head, a chamber into which a flow of gas (particularly air), in which said fibers are suspended, is directed, the chamber having a bottom opening closed by a screen mesh which is essentially parallel to said forming wire and which faces the latter; and agitator members inside said chamber, above said screen mesh, for agitating and distributing the fibers. Characteristically, the screen mesh is made to be continuous and movable along a closed path around said chamber, the portion of said mesh parallel to and facing the forming wire moving along a path which is essentially parallel to said forming wire. Additionally, the agitator members comprise a plurality of rotating shafts which are parallel to each other and orthogonal to the direction of advance of the forming wire, said shafts being provided with shaped profiles to agitate the fibers in the chamber.

The chamber is essentially closed off from the external environment, except at the bottom opening, past which the screen mesh runs. Thus a well-controlled flow of air and suspended fibers is generated, this flow being intercepted by the forming wire on which the web of fibers is formed. This web is subsequently consolidated in various ways, by known methods. The presence of a movable screen mesh and agitator members rotating about axes parallel to each other and to the plane of the screen mesh and consequently to the forming wire makes the device particularly efficient and suitable for forming a uniform web.

In a preferred embodiment of the invention, in order to feed the flow of air and suspended fibers into the chamber of the forming head, a plurality of diffusers is advantageously provided above the agitator members, the diffusers being provided with outlets, facing said agitator members, for the admission of said flow of air and fibers. The admission outlets can be made in a shape which is elongated, for example in a direction parallel to the axes of rotation of the agitator members. The diffusers can be aligned parallel to the axes of rotation of the agitator members. The distance between the inlet apertures, their size and their distance from the screen mesh are parameters which are chosen in such a way that the flows generated by the various aligned apertures intersect each other above the screen mesh. This provides a greater regularity of the thickness of the web formed on the forming wire.

In order to eliminate the lumps which may form in the chamber of the forming head, in an advantageous embodiment of the device suction members are associated with the chamber for sucking in and recycling the lumps. The lumps are then sent to known means which disintegrate them and recover the fibers which are reintroduced into the flow of air fed to the forming head.

In a particularly advantageous embodiment of the present invention, the suction members comprise at least one set of suction inlets adjacent to each other along a direction of alignment which is transverse with respect to the direction of advance of said forming wire. Preferably, two sets of suction inlets are provided, in the proximity of the upstream and downstream ends of the chamber with respect to the direction of advance of the screen mesh. These are the areas most likely to contain accumulations of lumps, which are thus promptly removed and recycled.

The agitator members can be rotated by a single motor unit. However, in a preferred embodiment of the invention, a plurality of independent motors can be provided, for groups of agitator members for example. Preferably, each agitator member comprises its own independent motor. The motors can be bidirectional, to enable the direction of rotation of the agitator members to be reversed. When an independent motor is provided for each agitator member, the velocity and direction of rotation of each agitator member can be controlled independently of the others.

The shaped profiles of the shafts of the individual agitator members can advantageously have a pointed configuration. They can be formed, for example, in a shape-approximating to an isosceles triangle, with the sides converging toward the vertex of the triangle being curved instead of straight and, in particular, concave toward the outside of the triangle. Additionally, the shaped piece preferably lies on a cylindrical surface whose axis coincides with the axis of rotation of the shaft of the corresponding agitator member. The various shaped profiles can be supported on and integral with disks keyed on the shafts of the agitator members. Each disk has one or preferably two profiles.

In order to obtain a particularly regular flow of air and fibers toward the screen mesh, a compartment for the introduction of an auxiliary flow of gas (particularly air) can be provided above the chamber into which the diffusers carrying the fibers suspended in the flow of air open, and holes can be made in a separating partition which divides the compartment from the chamber, to allow said auxiliary flow to pass from the compartment to the chamber. The auxiliary flow of air can be suitably controlled in respect of temperature and/or humidity, to ensure optimal conditions for forming the web. The velocity of the auxiliary flow and consequently the total quantity of air entering the chamber and passing out through the screen mesh can also be controlled, by adjusting the auxiliary flow and also if necessary the flow of air carrying the fibers which enters the chamber through the aforesaid diffusers.

In an advantageous embodiment of the device, the distance of the screen mesh from the agitator members is made adjustable, thus allowing the modification of the web forming conditions and consequently the characteristics of the product. For this purpose, the portion of said screen mesh forming the bottom closure of the chamber is advantageously guided by guide members whose distance from the agitator members is adjustable. These guide members can comprise, for example, an upper frame and a lower frame, essentially parallel to and spaced apart from each other, through which said screen mesh passes. The frames are supported in a position which is adjustable with respect to the agitator members. The frames advantageously have guide members for the screen mesh, and, in order to prevent or at least reduce the suction of air from the outside toward the forming wire, extendable sealing means can advantageously be provided between the guide members and the chamber of the forming head, these sealing means adapting themselves to the position taken up by the screen mesh with respect to the agitator members. Adjustable sealing means can also be provided between the guide members and the forming wire.

Further advantageous characteristics and embodiments of the invention are indicated in the attached claims and in the dependent claims.

BRIEF DESCRIPTION OF THE DRAWINGS

The invention will be more clearly understood from the description and the attached drawing, which shows a practical and non-restrictive embodiment of the invention. In the drawing, in which identical numbers indicate identical or corresponding parts.

DETAILED DESCRIPTION OF THE PREFERRED EMBODIMENT OF THE INVENTION

Figure 6:
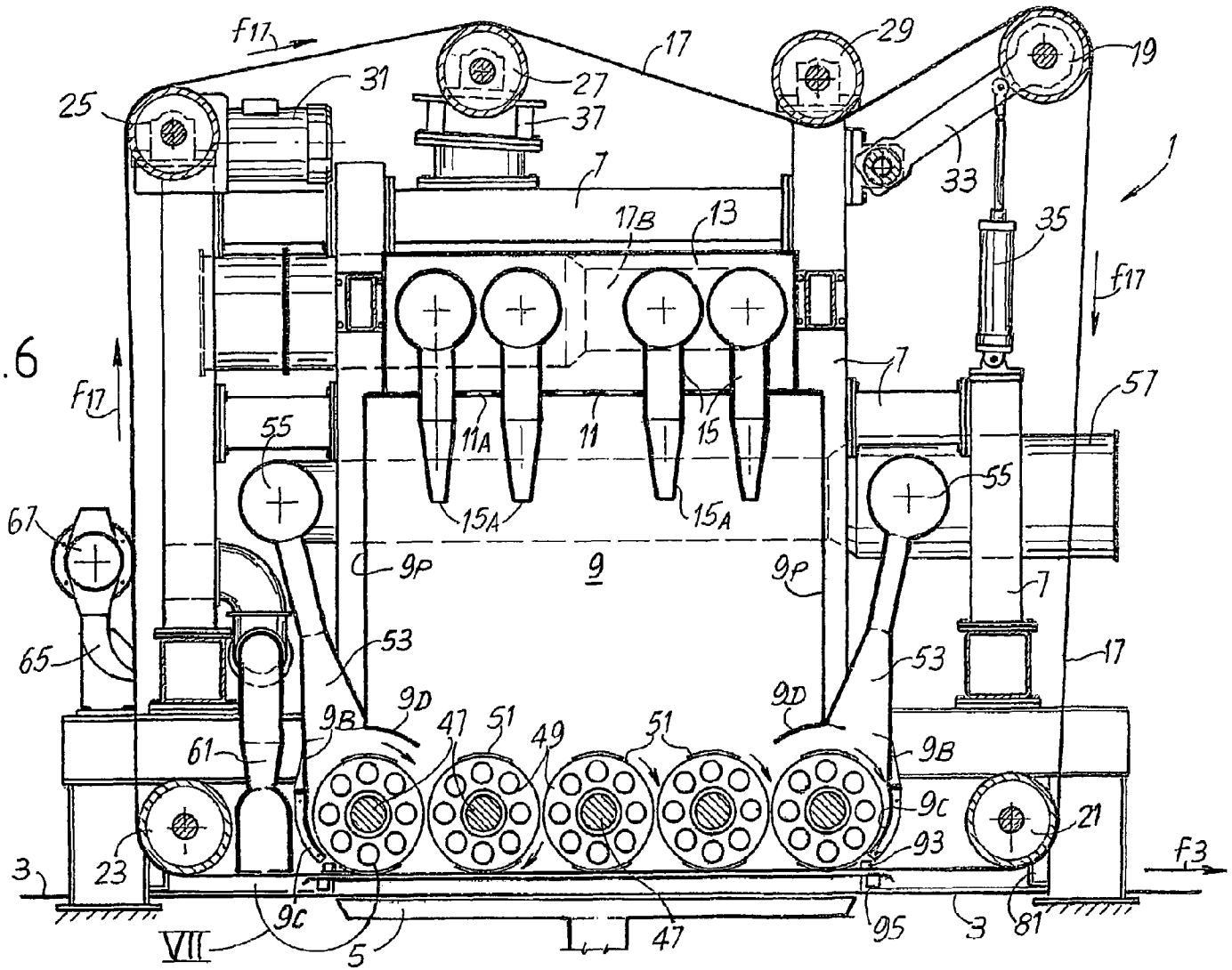
FIG. 6 shows a section according to a vertical plane indicated by VI-VI in FIG. 4.
Figure 7:
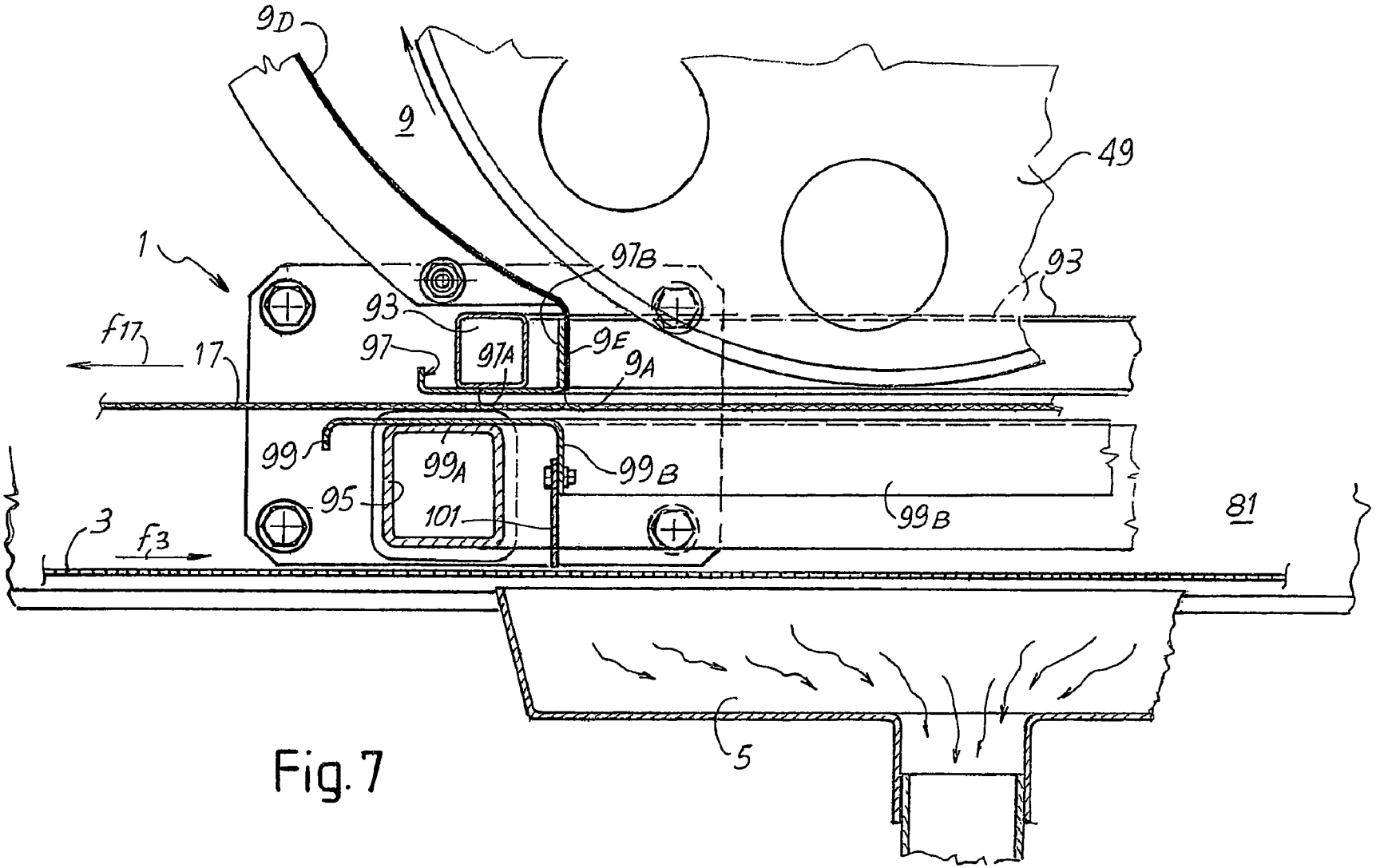
FIG. 7 shows an enlargement of the detail VII of FIG. 6.
Figure 8:
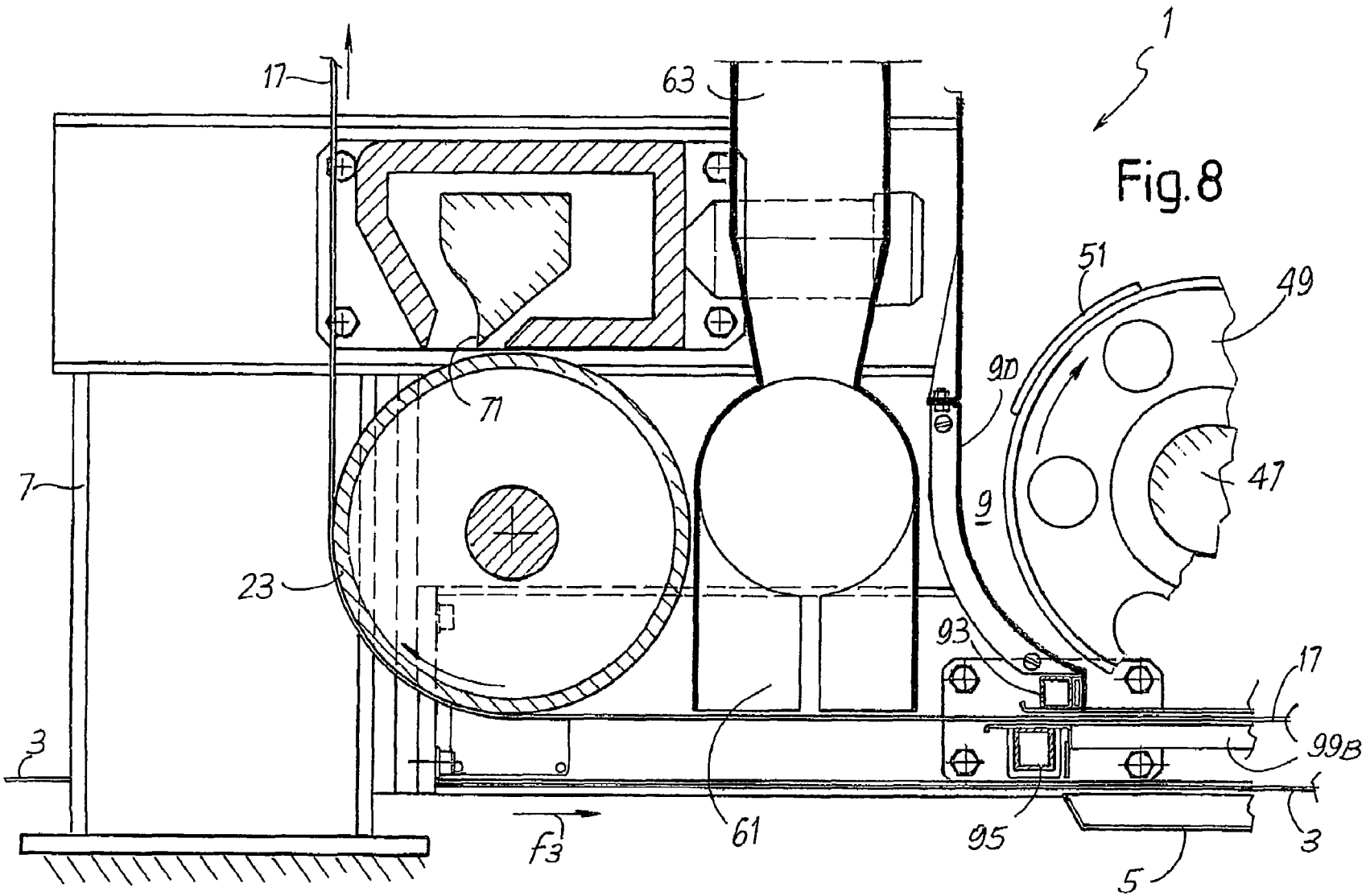
FIG. 8 shows an enlargement of the detail VIII of FIG. 6.

The device comprises, in a general way, a forming head, indicated as a whole by 1, and a forming wire 3, shown in particular in FIGS. 6 and 7 and omitted for the sake of simplicity in the other figures. A suction box 5 is positioned under the forming wire 3, in other words on the opposite side of the wire to that on which the forming head 1 is located. As described more fully below, a flow of air is fed into the forming head and draws with it fibers of cellulose or of other suitable material. The flow is sucked by the suction box 5, and the fibers are intercepted by the forming wire 1, thus generating on the screen a web V of fibers (FIG. 7), which is subsequently consolidated In a known way. The forming wire 3 advances in the direction of the arrow f3.

The head 1 has a supporting structure 7 inside which is positioned a chamber 9 into which the flow of air and suspended fibers is fed. The chamber 9 is of essentially parallelepipedal shape, delimited by four vertical walls and a top wall 11. The wall 11 forms a partition which separates the chamber 9 from a compartment 13 located above. Holes 11A are made in the wall 11 to bring the compartment 13 into communication with the chamber 9. An air supply pipe 14 opens into the compartment 13. The air introduced by the pipe 14 has controlled temperature and humidity, and penetrates into the underlying chamber 9 through the holes 11A in the wall or dividing partition 11.

From the wall 11 there extend towards the interior of the chamber 9 diffusers 15 terminating in outlets or nozzles 15A having a tapered shape elongated in a direction orthogonal to the direction of advance f3 of the forming wire 3. The diffusers 15 are positioned in four rows orthogonal to the direction of advance f3 of the forming wire 3. They are connected to two manifolds for the introduction of the flow of air and fibers, indicated by 18A and 18B, which are supplied by known means which are not shown. In practice, each of the two manifolds 18A and 18B supplies two rows of diffusers 15.

The chamber 9 is open at its bottom, and a screen mesh 17 runs past the opening 9A (FIG. 7) and extends along a closed path around said chamber 9. The path is delimited by rollers 19, 21, 23, 25, 27 and 29. The roller 25 is powered by a motor 31 and transmits the motion to the screen mesh 17, which moves continuously in the direction of the arrow f17. In the illustrated example, the portion of mesh which closes the bottom of the chamber 9 and is parallel to the forming wire 3 advances in the opposite direction to the direction of advance of said wire, although it would also be possible to make it advance in the same direction. The roller 19 is supported by a pair of movable oscillating arms 33 acted on by cylinder and piston actuators 35 which keep the screen mesh 17 under tension. The roller 27 is associated with known means 37 which modify the position of the axis of said roller to keep the screen mesh correctly guided.

The lower rollers 21 and 23, between which extends the lower branch of the screen mesh 17 closing the bottom opening of the chamber 9, have movable axes, and their position with respect to the bottom opening of the chamber 9 can be adjusted to modify the position of the screen mesh with respect to the agitator members which are located within the chamber 9 and which are described below.

Figure 1:
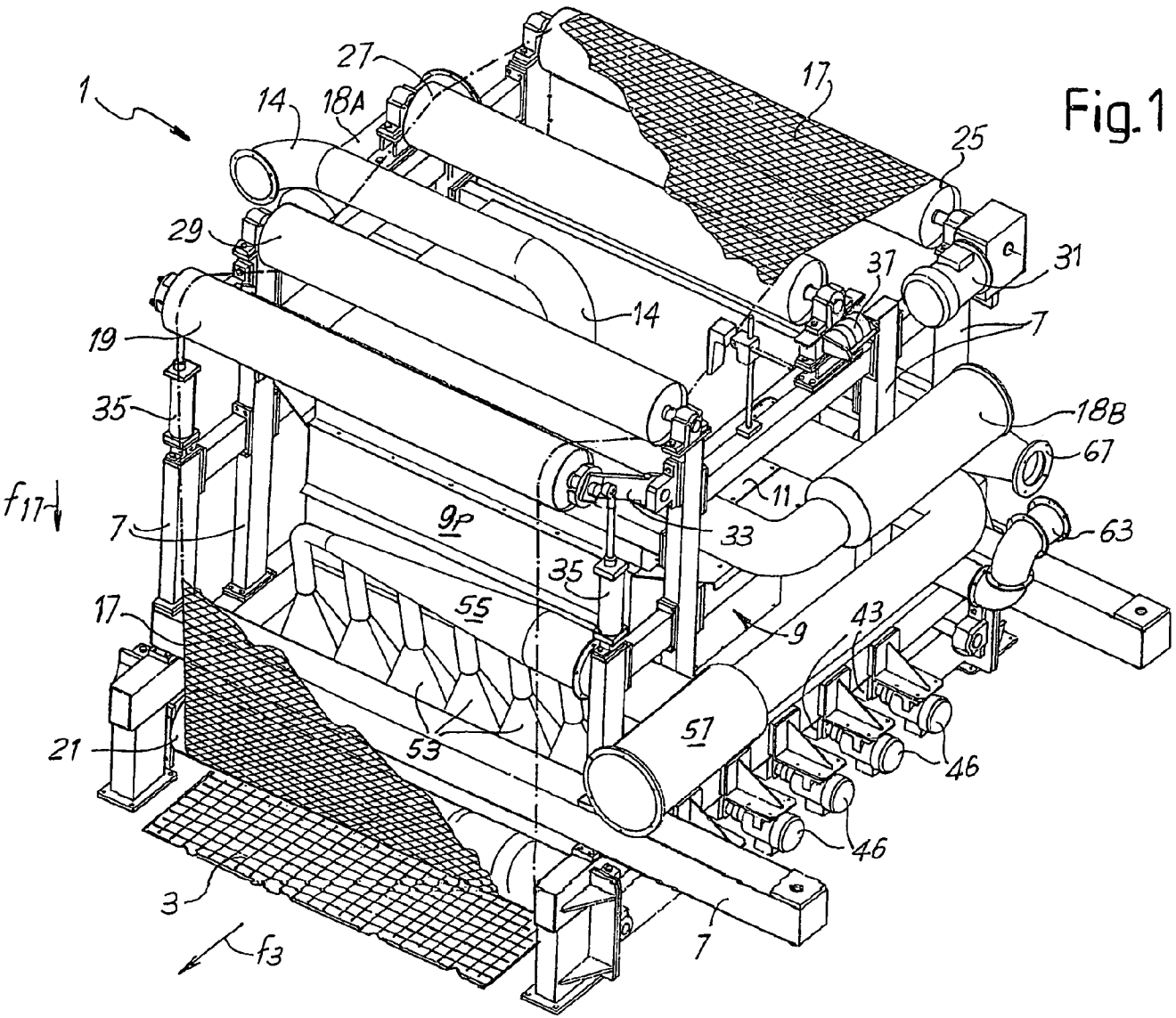
FIG. 1 shows a perspective view of the forming head.
Figure 2:
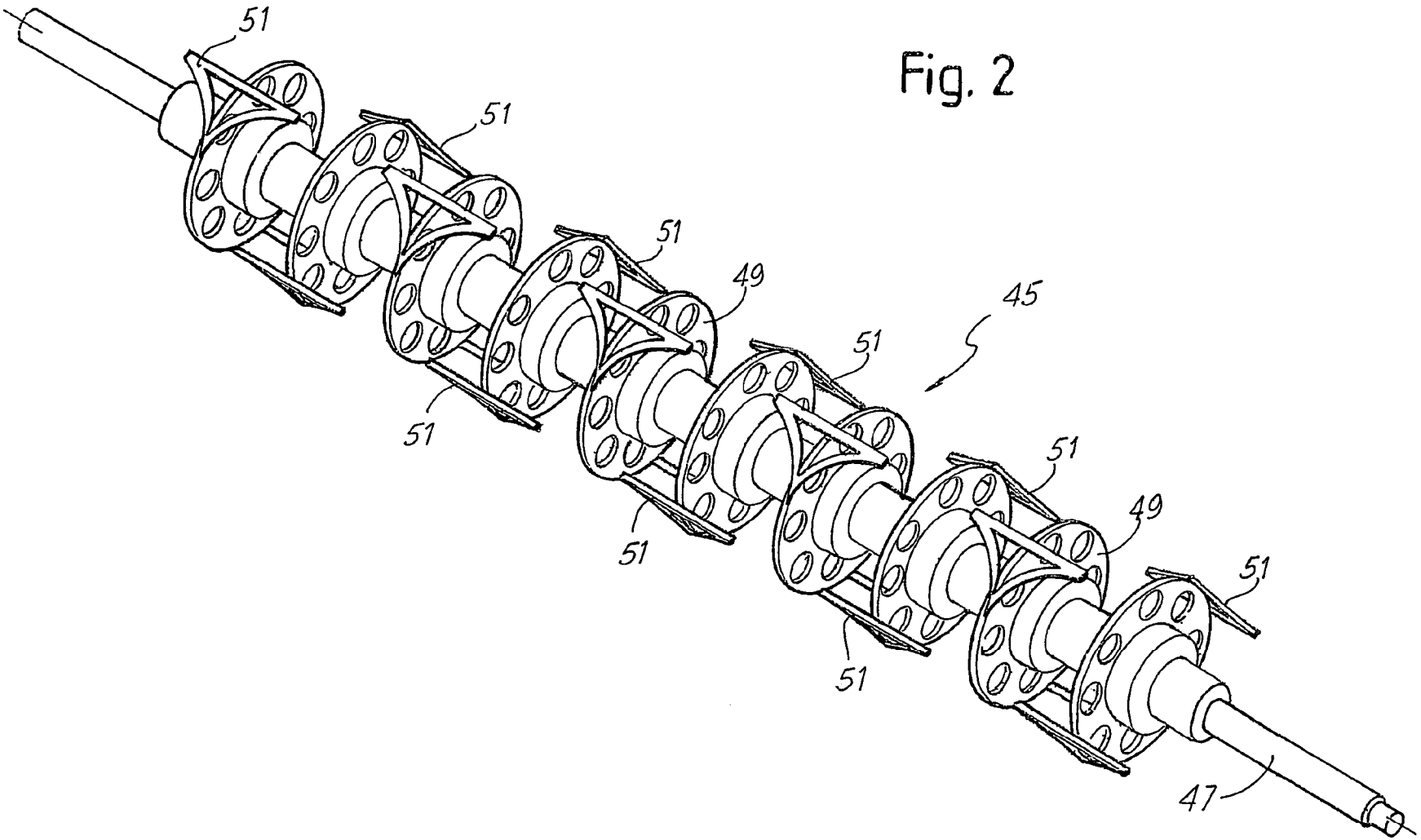
FIG. 2 shows a perspective view of one of the agitator members.

The structure 7 of the forming head 1 carries a set of supports 41 and 43, which support agitator members indicated as a whole by 45. One of said agitator members is shown in isolation and in a perspective view in FIG. 2. Each agitator member comprises a shaft 47, extending transversely with respect to the direction of advance of the forming wire 3 and of the screen mesh 17, and supported by a pair of supports 41 and 43. Each support 43 is associated with an independent variable-speed bidirectional motor 46, which rotates the corresponding shaft 47.

A plurality of disks 49 is keyed on each shaft 47. Two shaped profiles 51 are fixed on the circular edge of each disk 49. Each shaped piece has a pointed configuration, and consists essentially of three sides arranged in the form of an isosceles triangle whose vertex forms the aforesaid point. The sides converging on the vertex are curved, with the concavity facing the outside of the triangle. The triangle lies on a theoretical cylindrical surface coaxial with the corresponding shaft 47. The points formed by the two shaped profiles 51 integral with a single disk 49 are orientated in the same direction. In a different embodiment which is not illustrated, each shaped piece is double and symmetrical and has two opposed points, to produce the same effect on the fibers even when the direction of rotation is reversed.

As shown in particular in the section in FIG. 6, the end walls 9P of the chamber 9, in other words those orthogonal to the direction of advance f3 of the forming wire 3, terminate at their bases in a casing 9B which partially encloses the outer two agitator members 45. Two deflectors 9D extend into the chamber 9 above these outer agitator members. The lower part 9B and 9C of the end walls 9P and the deflectors 9D delimit the inlet area of two sets of suction inlets 53. The suction inlets 53 are arranged in two alignments which are transverse with respect to the direction of advance of the forming wire 3, adjacently to the outer two agitator members 45. In the illustrated example, six suction inlets 53 are provided for each set. The six suction inlets of each set are connected to a corresponding manifold 55 and the two manifolds 55 are connected to a suction pipe 57. A recycling air flow is sucked through this pipe and draws with it the lumps of fibers which have not passed through the screen mesh 17. The recycling air flow is sent to means of breaking the lumps and recovering the fibers, these means being known and not illustrated.

Between the return roller 23 and the corresponding end wall 9P, 9B, 9C of the chamber 9 there is positioned a suction member 61 which extends across the whole width of the screen mesh 17 and which is located adjacent to the inner surface of the screen mesh, in other words the surface facing the interior of the closed path of said mesh. The suction member 61 has the function of removing from the mesh any residues of fibers still adhering to it. It is connected to a suction pipe 63.

A suction member 65 connected to a suction pipe 67 is located outside the path of the screen mesh 17, between the return roller 23 and the return roller 25. The suction member 65 extends across the width of the screen mesh 17 and sucks away any fibers or residues adhering to said mesh.

The return roller 23 is associated with a doctor blade 71 which detaches any detritus or residues of fibers which may have been transferred from the screen mesh to the roller and remain adhering to said roller.

Figure 3:
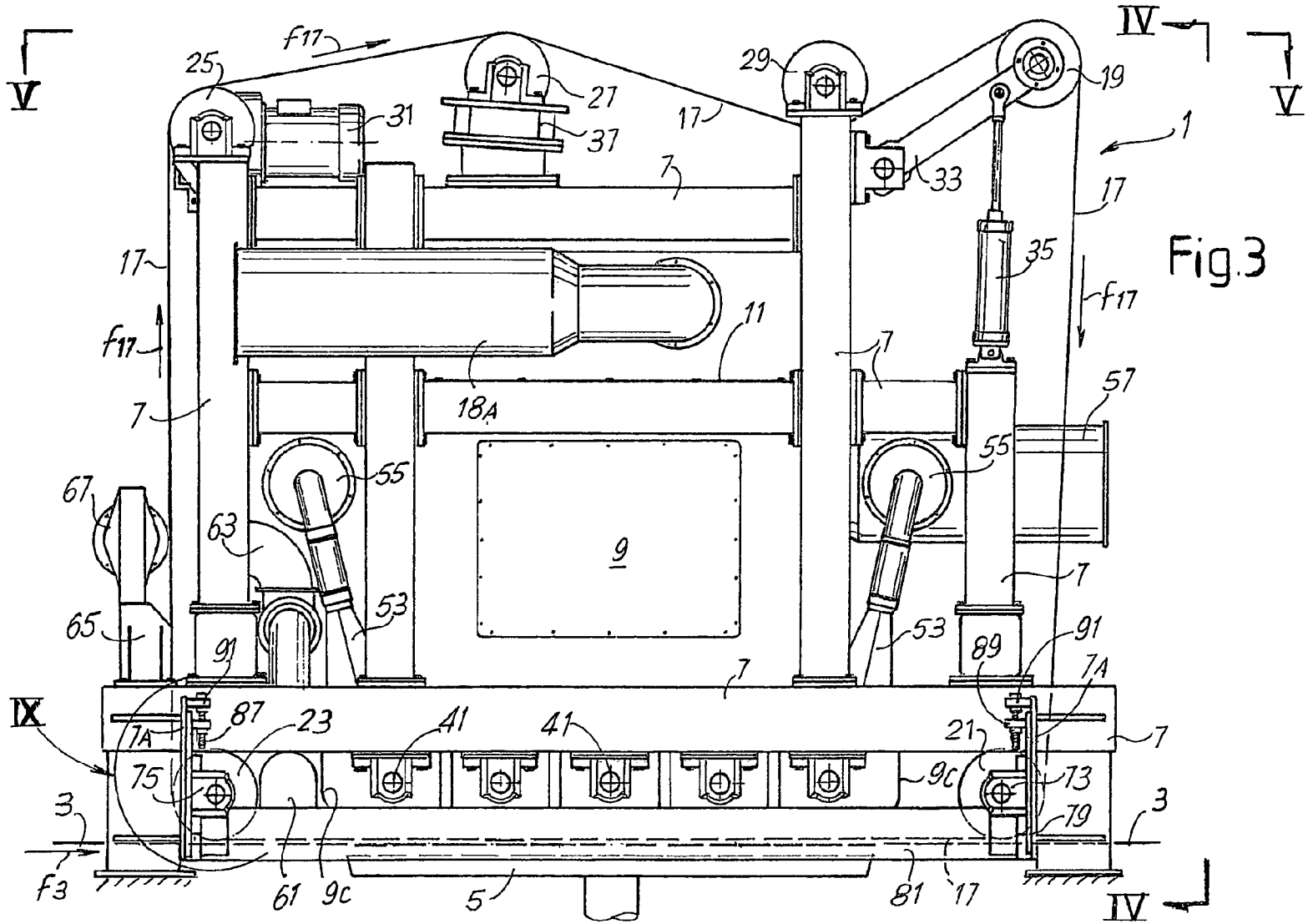
FIG. 3 shows a side view taken through III-III in FIG. 5.
Figure 4:
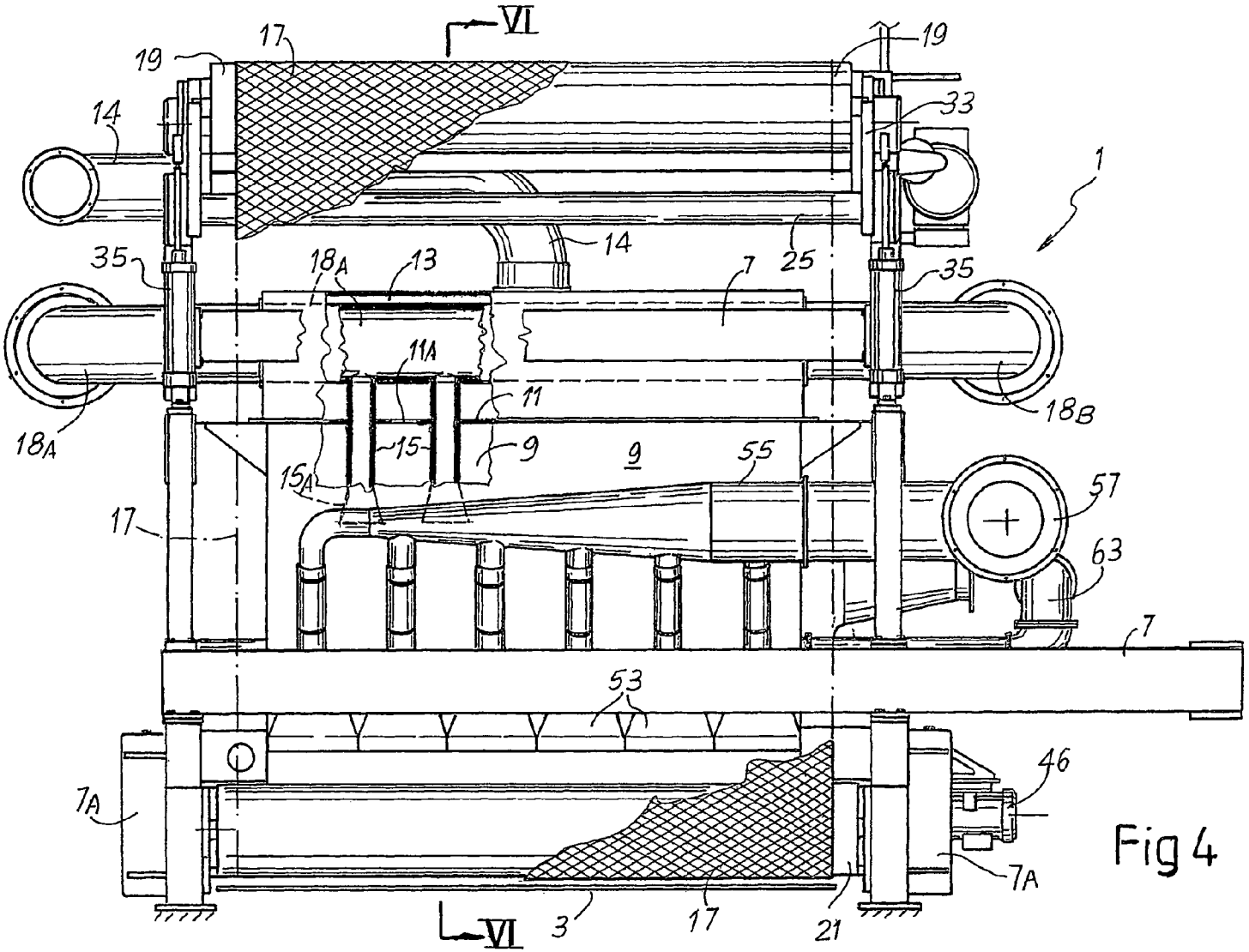
FIG. 4 shows a front view taken through IV-IV in FIGS. 3 and 5.
Figure 5:
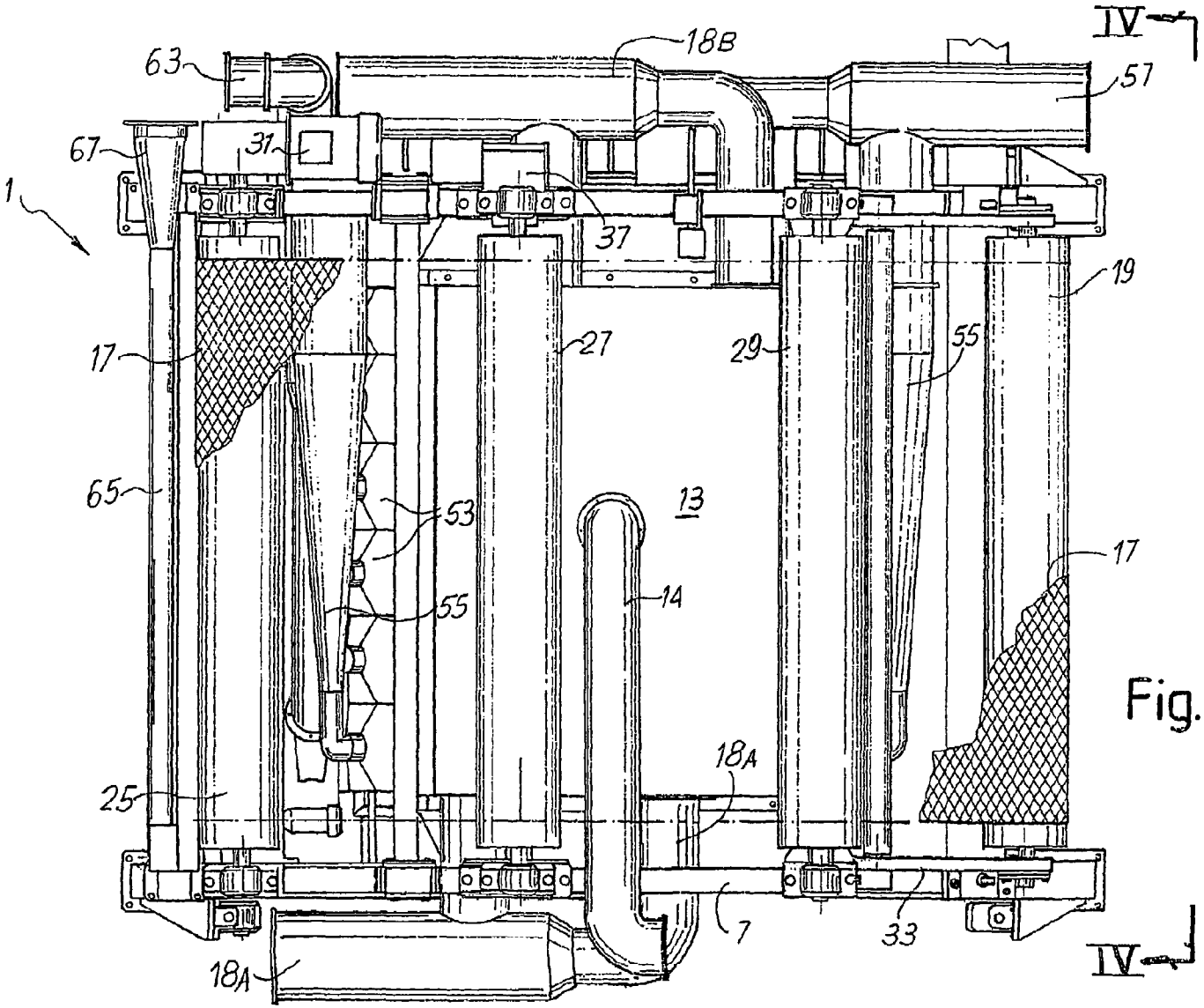
FIG. 5 shows a plan view taken through V-V in FIGS. 3 and 4.
Figure 9:
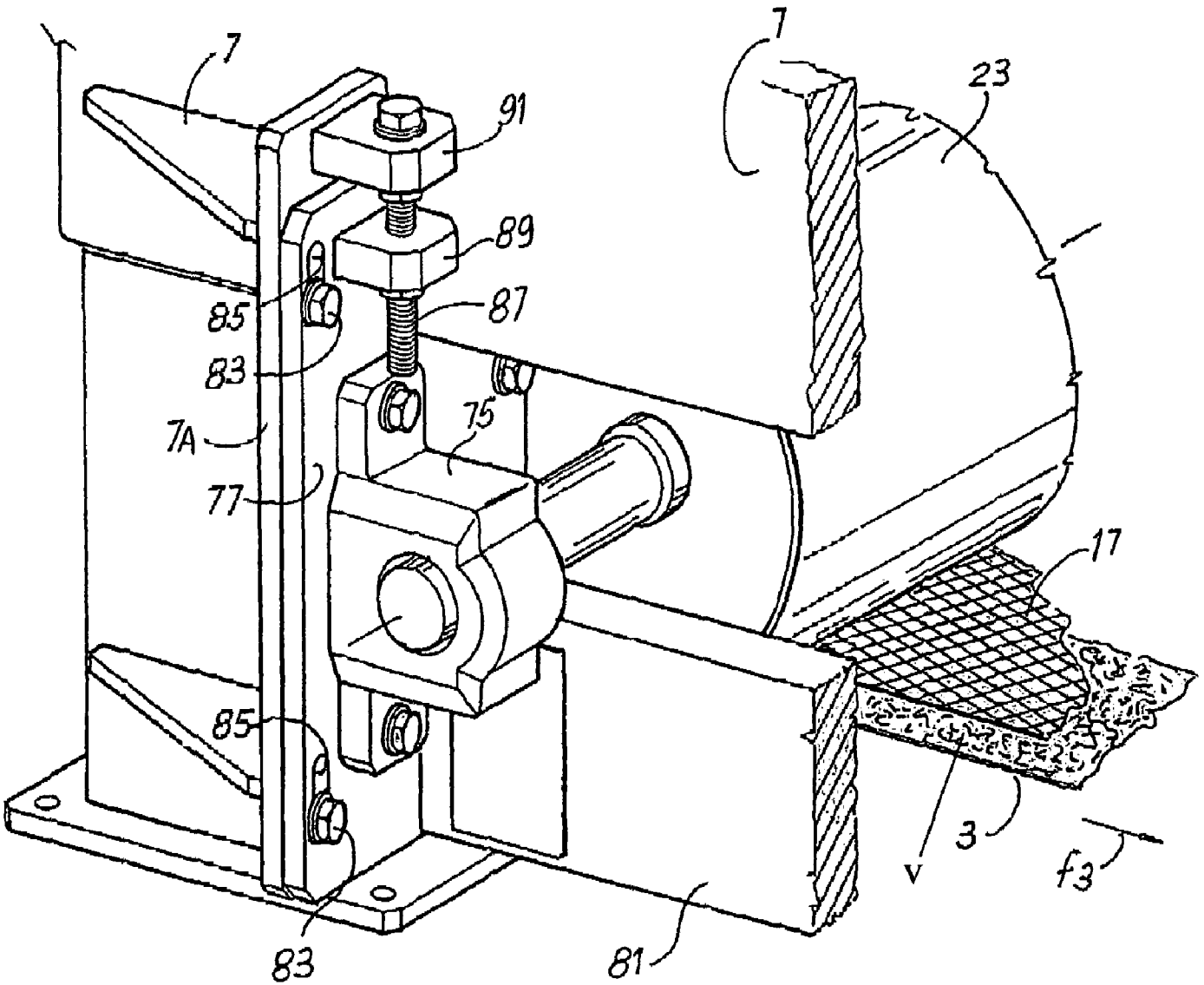
FIG. 9 shows a perspective view of the detail of FIG. 8.

As shown in particular in FIGS. 3, 6 and 9, the return rollers 21 and 23 are supported by two pairs of supports 73 and 75, fixed to two pairs of plates 77 and 79. Each pair of plates 77 and 79 is integral with a cross-member 81 which extends parallel to the direction of advance f3 of the forming wire 3. Each of the plates 77 and 79 is fixed to the fixed structure 7 by clamping screws 83 (FIG. 9) which are inserted into slotted holes 85 in said plates and are engaged in threaded holes (not visible) formed in a plate 7A forming part of the supporting structure 7. When the screws 83 are slackened, each of the plates 77 can be made to slide vertically, by means of an adjusting screw 87 engaged in a nut 89 integral with the corresponding plate 77 and supported by a block 91 integral with the structure 7. Thus it is possible to adjust the position of the pair of rollers 21 and 23 and consequently the position of the screen mesh 17 with respect to the structure 7 and therefore with respect to the agitator members 45.

The portion of the screen mesh 17 extending under the opening 9A of the chamber 9 is guided between two frames 93 and 95, these being the upper and lower frames respectively (see, in particular, FIG. 7). The two frames 93 and 95 are integral with the cross-members 81 and their vertical position is therefore adjustable. Each frame is formed from four square metal sections arranged in a rectangle, the sections forming the upper frame 93 having a smaller cross-section than that of the sections forming the lower frame 95. On the lower surface of the upper frame 93 there are fitted guide sections 97 which have a lower flange 97A for the actual guiding, parallel to the screen mesh 17, and a flange 97B orthogonal to the screen mesh 17, which extends parallel to a terminal wall 9E which delimits the opening 9A of the chamber 9. The two sections 97B and 9E which are parallel to each other form a kind of wall which can be telescopically extended and contracted when the cross-members 81, and consequently the two frames 93 and 95, are lowered and raised. This extendable and contractible wall forms a sealing system which prevents or at least drastically reduces the suction of air from the outside toward the suction box 5 located under the forming wire 3.

A guide section 99 with a horizontal flange 99A parallel to the flange 97A, and a vertical flange 99B, is fitted on the upper surface of the lower frame 95. Four lengths of metal section 99 welded along the four sides of the frame 95 form, with their respective flanges 99B, an outlet essentially corresponding to the opening of the chamber 9 located above. A box 101 is fitted around the outlet formed by the sections 99, and its position with respect to the frame 95 and to the sections 99 can be adjusted by means of a system of tightening screws and slots. The box 101 is open at its top toward the screen mesh 17 and at its bottom toward the forming wire 3, and delimits the space through which the flow of air and fibers leaving the screen mesh 17 reaches the forming wire 3 as a result of the suction applied by the suction box 5. Since the position of the box 101 can be adjusted with respect to the frame 95, the lower edge of said box can be positioned as closely as possible to the forming wire 3, thus reducing the passage cross section of the air sucked in from the outside through the forming wire 3.

With this particular arrangement, the distance of the screen mesh 17 from the agitator members 45 can be adjusted while the space under the opening 9A of the chamber 9, between said chamber and the forming wire, is kept essentially sealed, regardless of the position of the screen mesh.

The operation of the device described up to this point is as follows. The forming wire 3 is made to move, by means of powered and return rollers, which are not shown and which are of known types, in such a way that it passes under the forming head 1 at an essentially uniform velocity. The pressure in the suction box 5 is reduced. A flow of air with suspended fibers is fed into the chamber 9 of the forming head 1 through the manifolds 18A and 18B and the diffusers 15. In addition to the main flow from the diffusers 15, in which the fibers are suspended, a secondary air flow is blown into the chamber 9 through the pipe 14 and the compartment 13. The agitator members 45 are rotated, normally all at the same velocity and in a direction of rotation such that the points of the shaped profiles 51 have a tangential velocity essentially matching the direction of advance of the screen mesh 17 and the forming wire 3. Thus the fibers located nearest to the screen mesh are pushed by the concave portions of the profiles 51 towards the sides of the chamber and are distributed uniformly over the surface of the mesh facing them through the opening 9A of the chamber 9. Additionally, the movement of the profiles 51 in the upper part of their path creates turbulence in the flow of air and fibers, thus providing a better and more uniform distribution of the fibers in the space of the chamber 9, and also preventing the formation of lumps.

By suitably programming the control unit of the forming head, the velocity of rotation of the individual agitator members 45 can be modified, and the direction of rotation of one or more of them can also be reversed if necessary.

The suction inlets 53 are kept at slightly reduced pressure and suck in the lumps of fibers which reach the front and rear ends of the chamber 9 (with respect to the direction of advance of the forming wire 3) and enable the fibers forming these lumps to be recovered and recycled after dissolution of said lumps.

It should be understood that the drawing shows only one possible embodiment of the invention, which can be varied in its forms and arrangements without departure from the scope of the essential concept of the invention. The presence of reference numbers in the attached claims has the sole purpose of facilitating the reading of the claims with reference to the preceding description and the attached drawings, and does not in any way limit the protective scope of the claims.

The invention claimed is:

1. A device for dry forming a web of fibers, the device comprising:

a fiber distribution head;

a forming wire adjacent to said fiber distribution head, said fiber distribution head being located on one side of said forming wire, said forming wire being movable in a forming wire direction;

a suction means located on another side of said forming wire such that said suction means is located opposite said head;

a screen mesh;

a chamber defined within said fiber distribution head, said chamber receiving a flow of gas, said gas including fibers suspended therein, said chamber having a bottom opening closed by a portion of said screen mesh, said portion of said screen mesh extending substantially parallel to said forming wire, said portion of said screen mesh being disposed opposite said forming wire, said portion of said screen mesh having a surface disposed opposite an interior of said chamber; and agitator members arranged within said chamber, said agitator members being arranged adjacent to said screen mesh, said agitator members agitating and distributing the fibers on said surface of said portion of said screen mesh, said screen mesh being continuous and movable along a closed path around said chamber, said portion of said mesh screen being movable along a path which is essentially parallel to a path of said forming wire, said agitator members comprising a plurality of rotating shafts, each rotating shaft being parallel to another rotating shaft and to said screen mesh, each rotating shaft being orthogonal to said forming wire direction, each of said rotating shafts having shaped profiles for agitating the fibers in said chamber, each rotating shaft having an axis of rotation, each rotating shaft being rotatable about said axis of rotation.

2. A device according to claim 1, wherein a plurality of diffusers are in communication with said chamber, each of said diffusers being positioned above said agitator members, each diffuser having outlets for supplying said flow of gas and fibers, each outlet being disposed opposite one of said agitator members.

3. A device according to claim 1, wherein said chamber is associated with suction members for sucking in and recycling lumps of fibers which do not pass through said screen mesh.

4. A device according to claim 3, wherein said suction members comprise at least one set of suction inlets, one suction inlet being adjacent to another suction inlet along a direction of alignment, said direction of alignment being substantially perpendicular to said forming wire direction.

5. A device according to claim 4, wherein said at least one set of suction inlets is aligned parallel to said axis of rotation of each of said agitator members.

6. A device according to 4, wherein said suction members comprise two sets of suction inlets located at two opposite ends of the chamber along a direction of advance of said screen mesh.

7. A device according to claim 1, wherein each of said agitator members comprises an independent motor.

8. A device according to claim 7, wherein each of said independent motors is bidirectional.

9. A device according to claim 1, wherein each of said shaped profiles has a configuration with at least one point.

10. A device according to claim 1, wherein each of said agitator members comprises a shaft on which is keyed a plurality of disks, each disk being connected to at least one of said shaped profiles.

11. A device according to claim 10, wherein each of said profiles has at least one configuration essentially in a shape of an isosceles triangle, each of said profiles extending along a cylindrical surface of one of said disks, each of said profiles having curved sides which converge at a vertex, each of said sides of said profiles having a concavity facing in a direction outside of the triangle to form a point.

12. A device according to claim 10, each of said disks is associated with at least two of said shaped profiles, each of said shaped profiles having at least one point.

13. A device according to claim 1, wherein is located at a position above said chamber, said compartment delivering an auxiliary flow of gas, wherein a separating partition separates said compartment from said chamber, said separating partition having holes, said holes receiving auxiliary flow of gas such that said auxiliary flow of gas passes from said compartment to said chamber.

14. A device according to claim 2, wherein said diffusers extend from a separating partition towards said interior of said chamber.

15. A device according to claim 2, wherein each of said diffusers is aligned with another diffuser such that each of said diffusers is arranged essentially parallel to each axis of rotation of said rotating shafts of said agitator members.

16. A device according to claim 2, wherein each of said diffusers terminate in outlets elongated in a transverse direction with respect to said forming wire direction, wherein a jet of gas and suspended fibers delivered via one diffuser intersects with a jet of gas and suspended fibers delivered via an adjacent diffuser at a position located above said screen mesh.

17. A device according to claim 1, wherein a distance from said screen mesh to said agitator members is adjustable.

18. A device according to claim 1, wherein said portion of said screen mesh is guided by guide members, wherein a distance from said guide members to said agitator members is adjustable.

19. A device according to claim 18, wherein said guide members comprise an upper frame and a lower frame, said upper frame being essentially parallel to said lower frame, said upper frame and said lower frame defining a screen mesh portion space, said portion of said screen mesh extending through said screen mesh portion space.

20. A device according to claim 19, wherein said upper and lower frames are supported in a position which is adjustable with respect to a position of the agitator members.

21. A device according to claim 20, wherein said upper and lower frames are supported by a sliding block which can be adjusted and clamped on the supporting structure of said head.

22. A device according to claim 21, wherein said sliding block supports at least two return rollers of said screen mesh, said portion of said screen mesh extending between one of said return rollers and another of said return rollers.

23. A device according to claim 19, wherein said upper frame is integrally connected with a guide section for said screen mesh.

24. A device according to claim 19, wherein said lower frame is integrally connected with a guide section for said screen mesh.

25. A device according to claim 18, wherein an extendable sealing means is positioned between said guide members and said chamber.

26. A device according to claim 19, wherein an extendable sealing means comprises a section integrally connected with said upper frame, said section cooperating with a perimetric edge surrounding the bottom opening of said chamber.

27. A device according to claim 18, wherein an adjustable sealing means is arranged between said guide members and said forming wire.

28. A device according to claim 19, wherein an adjustable sealing means comprises a box having an opening located opposite said screen mesh and another opening located opposite said forming wire, said box being supported by said lower frame.

29. A device according to claim 1, further comprising an internal cleaning means cleaning the surface of the screen mesh disposed opposite said interior of said chamber.

30. A device according to claim 29, wherein said internal cleaning means is a suction device.

31. A device according to claim 1, further comprising an external cleaning means for cleaning a surface of the screen mesh disposed opposite said forming wire.

32. A device according to claim 31, wherein said external cleaning means is a suction device.

33. A device according to claim 1, wherein said screen mesh extends around a plurality of return rollers, each of said return rollers being located around said chamber, each of said return rollers being located at a position outside of said chamber, at least one of these rollers being powered via a motor.

34. A device according to claim 33, wherein at least one of the return rollers is located directly downstream from the bottom opening of the chamber with respect to a direction of advance of said screen mesh, said at least one of said return rollers being associated with a doctor blade means for removing detritus adhering to said roller.

35. A device according to claim 33, wherein at least one of said return rollers is supported in a movable way for tensioning said screen mesh.

36. A device according to claim 33, wherein at least one of said return rollers is associated with a means of aligning said screen mesh.

37. A device according to claim 13, wherein said chamber and said compartment is delimited outwardly by a box, said box having an opening being located adjacent to said screen mesh.

38. A device according to claim 10, wherein each of said shaped profiles is symmetrical, each of said shaped profiles having two points orientated in two opposed directions in a tangential direction of said disks.

* * * * *